US006367907B1

(12) United States Patent
Gil Miquel

(10) Patent No.: US 6,367,907 B1
(45) Date of Patent: Apr. 9, 2002

(54) METHOD AND APPARATUS FOR FLUSHING INK TUBES

(75) Inventor: Antoni Gil Miquel, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/429,251

(22) Filed: Oct. 29, 1999

(51) Int. Cl.[7] ..... B41J 2/165
(52) U.S. Cl. ..... 347/35
(58) Field of Search ..... 347/35, 28, 85, 347/84, 23, 22, 19

(56) References Cited

U.S. PATENT DOCUMENTS 5,138,344 A 8/1992 Ujita ..... 347/86
5,589,861 A * 12/1996 Shibata ..... 347/28 X
5,625,384 A * 4/1997 Numata et al. ..... 347/23
5,638,099 A * 6/1997 Nguyen et al. ..... 347/2
5,812,156 A * 9/1998 Bullock et al. ..... 347/19
5,825,380 A * 10/1998 Ichizawa et al. ..... 347/28
5,923,347 A * 7/1999 Wade ..... 347/28
6,025,441 A * 2/2000 Nishimoto ..... 347/85
6,126,265 A * 10/2000 Childers et al. ..... 347/23

FOREIGN PATENT DOCUMENTS

JP 63-260451 * 10/1988 ..... B41J/3/04
JP 7-809092 A * 4/1995 ..... B41J/2/175

OTHER PUBLICATIONS

Storage of Operating Parameters in Memory Integral with Printhead By Robert A. Lonis in Xerox Disclosure Journal vol. 8 No. 6 Nov./Dec. 1983 p. 503.

* cited by examiner

*Primary Examiner*—David F. Yockey

(57) ABSTRACT

In a method and apparatus, ink tubes are flushed by replacing a plurality of components of an ink delivery system with a plurality of purging components. Purging is controlled In response to the replacement of the components, wherein purging fluid is introduced into the inlet end of a tube in an ink delivery system, a printhead is operated to cause the purging fluid to flow through the tube and be expelled by the printhead, and the purging fluid is collected. Each of the components is provided with identifying information which can be provided to a microprocessor in the apparatus.

20 Claims, 3 Drawing Sheets

METHOD AND APPARATUS FOR FLUSHING INK TUBES

FIELD OF THE INVENTION

This invention relates to inkjet printers, and in particular to a method and apparatus for flushing ink tubes in an inkjet printer.

BACKGROUND OF THE INVENTION

Conventional inkjet printers have typically employed a self-contained printing cartridge, composed of a reservoir and printhead in one unit. Ink from the reservoir flows into a number of chambers in the printhead. The chambers are then quickly heated causing the ink to expel onto a printing media, for example, paper, acetate, cloth, etc. A separate printhead-cleaning device is utilized to clean the printhead by providing at least one wiper, over which the printhead passes, to wipe off any accumulated ink, ink residue or fibers remaining from the media being printed upon.

Over time inkjet printing has become more sophisticated, and now delivers the capability to print in any number of colors, complicated graphic designs, utilizes a vast number of different fonts, and is able to print photographs. As a result, later generation printers, especially large-format ones, consume more ink and utilize different ink compositions.

In order to accommodate higher ink consumption without having an operator change cartridges more often, the "all in one" printing cartridge has evolved to a more complex ink delivery system. The system includes a printhead, an ink reservoir, a printhead cleaning device (collectively referred to as printing components) and a tube connecting the reservoir to the printhead. The ink reservoir is usually easily replaceable and typically holds a larger quantity of ink than the printing cartridge design.

The number of ink compositions available for use in ink jet printers has also increased in order to provide the number of colors and photographic quality desired by users. However, some new ink compositions are incompatible with previous ink compositions. For instance, installing an ink cartridge with a new ink composition, while an old ink is present in the tubing or printhead, may result in the new ink composition combining with the old ink composition to form a precipitate, clogging the tubing or the printhead. Also, other problems may occur when installing an ink cartridge with a new ink composition, while the old ink is still present in the tubing and printhead of the printer, if the properties of the new ink are altered. This can be an especially severe problem when the new ink has a different color than the previously used ink. Thus, until the old ink is purged, print quality generally suffers. In general, any time a new ink composition is to be used in place of a non-identical ink composition, a potential incompatibility issue is presented (e.g., different colors, densities, solvents, pigments, surfactants, etc.).

In order to provide larger quantities of ink and multiple compositions of ink, printer manufacturers offer multiple printheads supplied by multiple reservoirs. However, because it is impractical to supply every type of ink desired in a particular printer, users must still change inks with all the incompatibility problems mentioned above. In printers utilizing a reservoir separate from the printhead, it is desirable to be able to change inks without mixing a new ink with an old ink.

One solution to the problems associated with incompatible ink compositions is to change the printing components, i.e. the reservoir, printhead, printhead cleaner, and the associated tubing during each ink change. By example, a printer utilizing separate reservoirs and printheads causes the printheads to regularly dock into a refill station. The reservoirs then connect to their corresponding printheads through short tubes which are integral to each reservoir. When changing ink types, a user may then change the reservoirs and tubes as a single assembly and also change the printheads and printhead cleaning devices. This system has the advantage of replacing all parts that contact the ink, thus eliminating any possible mixing of old ink and new ink. This method has a disadvantage in that it cannot be used on higher throughput printers where the tubing is more permanently routed inside the printer and difficult to access.

Another solution is to provide as many tubes in the printer as desired ink compositions. For example, if the user contemplates using eight different compositions of ink, then eight tubes are required. However, if later in time, additional ink compositions are desired, more tubes need to be installed. Anticipating the number of ink compositions and providing room for the contemplated tubing is impractical.

Another solution is to clean or purge the tubes of the previously used ink. In higher throughput printers where the tubing is more permanently routed inside the printer and difficult to access, this operation requires some disassembly of the printer in order to flush the tubes with distilled water. This procedure requires some provision for collecting the used distilled water and also requires some training for the operator and some protection against ink spillage.

It is desirable then to perform purging operations automatically, in order to minimize user intervention. Information devices may be incorporated into the printing components which identify them to a processor in the printer. A proposal to incorporate a parameter memory into ink jet printheads can be found in the publication entitled "Storage of Operating Parameters in Memory Integral with Print Head", Lonis, Xerox Disclosure Journal, Volume 8, No. 6, November/December 1983. The author discusses storage of operating parameters to be used by a printer for calibration purposes, including drop generator driver frequency, ink pressure and drop charging values.

Also of interest is U.S. Pat. No. 5,138,344 to Ujita, entitled "Ink Jet Apparatus and Ink Jet Cartridge Therefor." This patent indicates that an ink-containing replaceable reservoir can be provided with an integral information device (i.e., a resistor element, magnetic medium, bar code, integrated circuit or ROM), for storage of information relating to control parameters for an ink jet printer.

Accordingly it is an object of this invention to provide a method and apparatus for purging old ink from an ink delivery system in a printer and recharging the ink delivery system with new ink.

SUMMARY OF THE INVENTION

A method and apparatus are disclosed for purging a tube in an ink delivery system in a printer, where a purging fluid is introduced into the inlet end of the tube. The printhead of the ink delivery system is operated to cause the purging fluid to flow through the tube and be expelled by the printhead, and the purging fluid is collected.

A purging reservoir, a purging printhead, and a purging printhead cleaning device are provided for use in an ink jet printer having a replaceable ink reservoir, a replaceable printhead and a replaceable printhead cleaning device. The purging reservoir, purging printhead, and purging printhead cleaning device are installed in place of the respective replaceable printing components. The purging reservoir contains a purging solution for cleaning ink from the tubing in the printer which connects the reservoir with the printhead. Upon installation, a processor in the printer recognizes the purging printing components and initiates a purging procedure, cleaning old ink from the tubing and charging the tubing with new ink.

The purging reservoir, purging printhead, and purging printhead cleaning device may be incorporated into a kit.

The kit may also include a computer storage medium containing a program for use by a processor in the printer wherein the processor operates to control the purging procedure in accordance with the program.

DETAILED DESCRIPTION OF THE INVENTION

Figure 1:
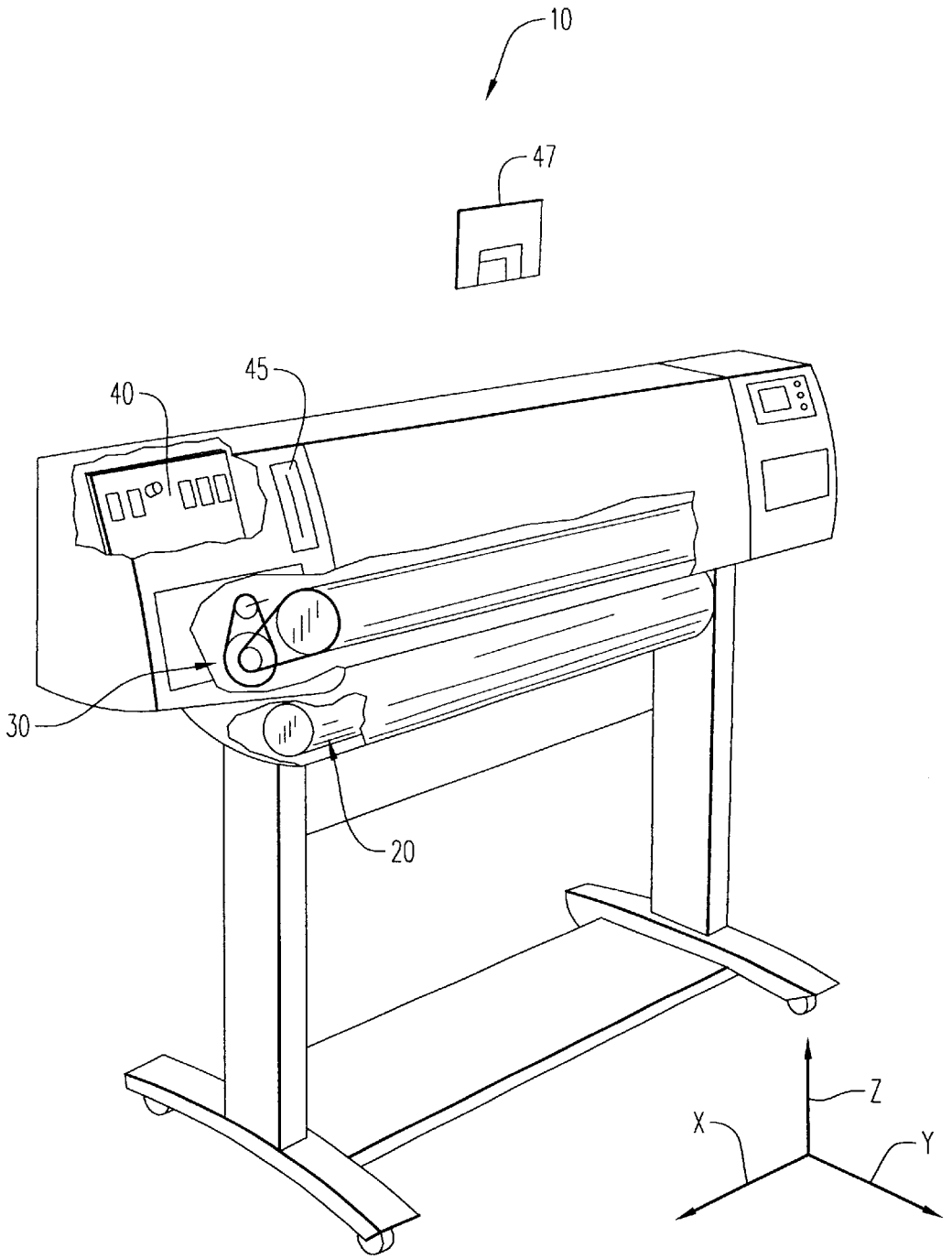
FIG. 1 is a perspective view of a printer in accordance with the invention in cut-away form.
Figure 2:
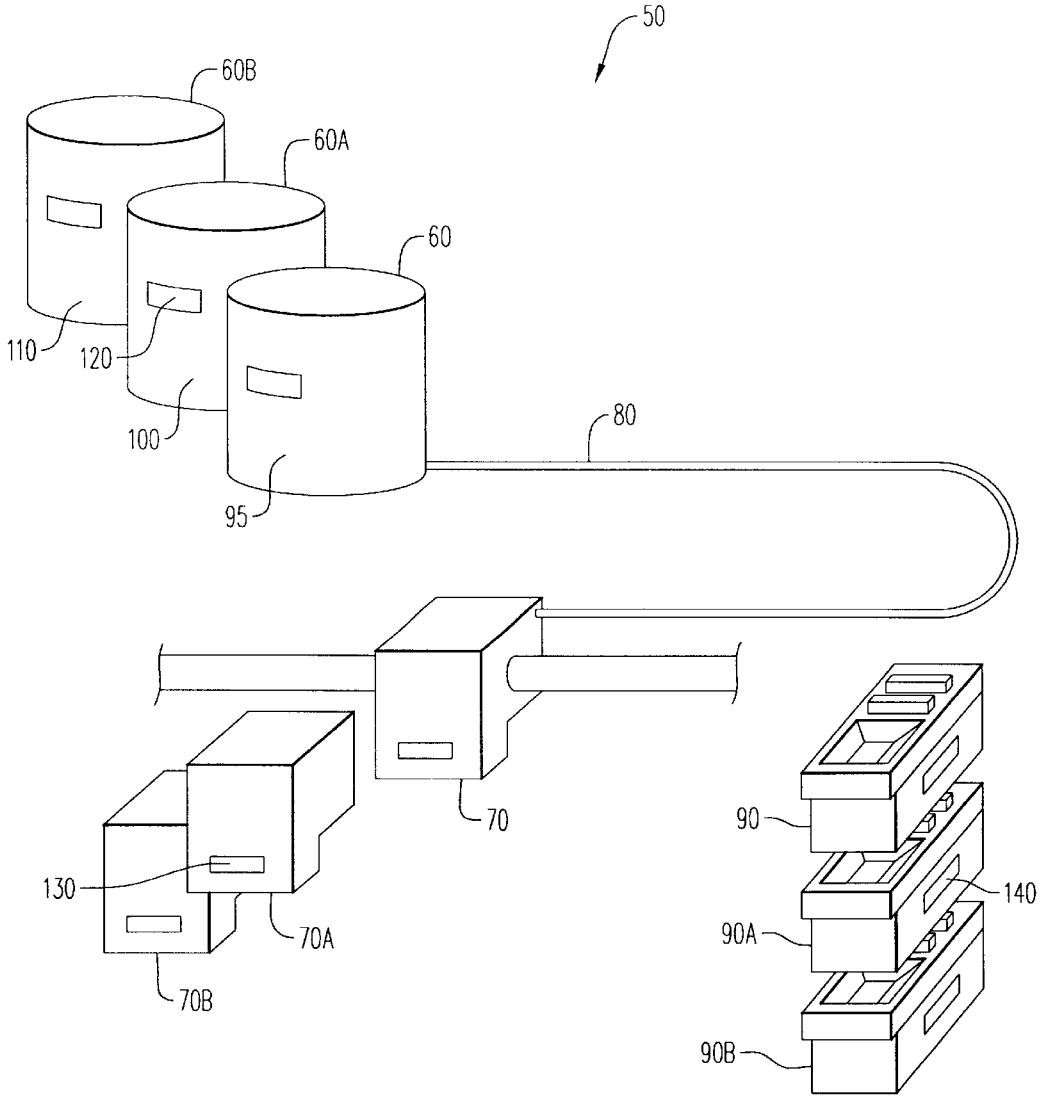
FIG. 2 is a schematic diagram of an ink delivery system.

A printer 10 in which this invention is practiced is shown in FIG. 1. Printer 10 includes printing media 20, for example, paper, mechanism for positioning media 30,and processor 40 for directing printer operations. FIG. 2 shows ink delivery system 50, also included in printer 10.

In FIG. 1 media positioning mechanism 30 feeds media 20 into a printing area, positions it for printing, that is, for receiving ink from ink delivery system 50, and then ejects media 20 when printing is complete. Media 20 may be continuous, for example, in roll form, and in that case media positioning mechanism 30 may also incorporate a cutting mechanism for separating printed portions of media 20 from the continuous roll.

Processor 40 has control lines and an on-board memory, which are utilized to direct the activities of printer 10. The on-board memory includes programs or procedures which processor 40 executes, either automatically or in response to input from an external device or an operator. Processor 40 preferably includes a facility 45 for receiving and storing additional programs contained on computer storage media 47, such as a floppy disk drive, a compact disk drive, or a memory cartridge bay.

Turning now to FIG. 2, ink delivery system 50 includes at least one ink reservoir 60, at least one printhead 70, and at least one tube 80 which provides fluid communication between the ink reservoir 60 and the printhead 70. Ink delivery system 50 also includes at least one printhead cleaning device 90. Ink reservoir 60 is replaceable by other reservoirs 60A, 60B and ink delivery system 50 is adapted to receive a plurality of replaceable reservoirs containing one or more ink compositions. Printhead 70 and printhead cleaning device 90 are also replaceable and ink delivery system 50 is further adapted to receive a plurality of printheads and printhead cleaning devices.

In accordance with the invention, when an operator desires to use new ink composition 110 contained in new reservoir 60B, replaceable reservoir 60 containing old ink 95 is first replaced with purging reservoir 60A. Purging reservoir 60A contains purging fluid 100 for purging tube 80 connecting purging reservoir 60A and printhead 70. Purging fluid 100 may be any fluid that is capable of purging tube 80 in accordance with a purging procedure as explained in greater detail below. Preferably, purging fluid 100 is a liquid vehicle, or solvent, compatible with both old ink composition 95 and new ink composition 110.

Replaceable printhead 70 is also replaced with purging printhead 70A that is configured to be compatible with old ink composition 95, purging fluid 100, and new ink composition 110. Purging printhead 70A is selected to perform a purging function and, as such, need not have full printing capabilities or be capable of meeting image quality standards for printing.

Further, replaceable printhead cleaning device 90 is also replaced with purging printhead cleaning device 90A. Purging printhead cleaning device 90A is capable of receiving and containing old ink composition 95, purging fluid 100, and new ink composition 110 to be expelled from purging printhead 70A. Purging printhead cleaning device 90A is further capable of containing old ink composition 95, the purging fluid 100, and new ink composition 110, even if it is turned over or dropped.

Figure 3:
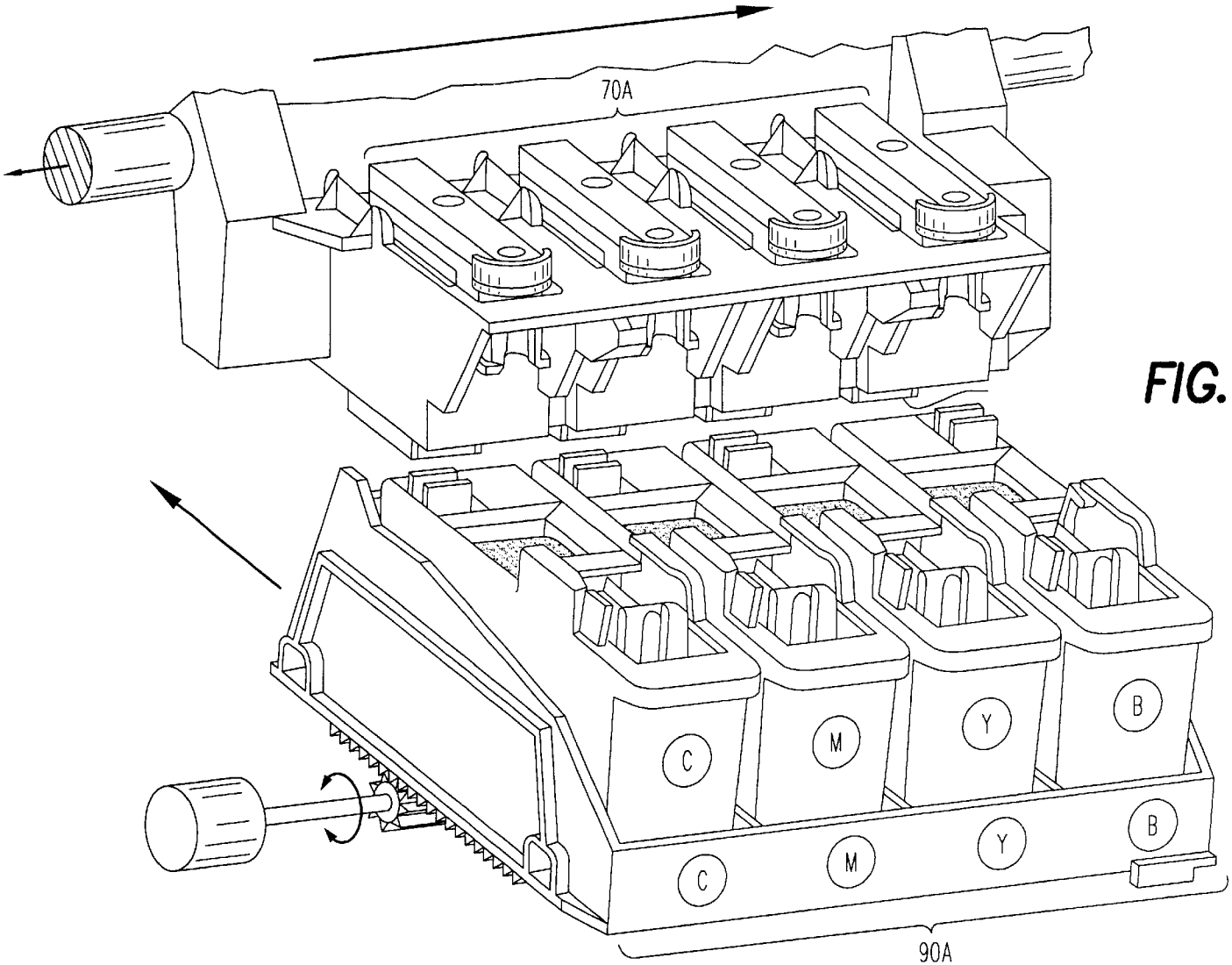
FIG. 3 is a perspective view of a plurality of printheads positioned over a corresponding plurality of printhead cleaning devices.

Upon replacement of replaceable reservoir 60, printhead 70 and printhead cleaning devices 90, with purging reservoir 60A, purging printhead 70A and purging printhead cleaning device 90A, respectively, processor 40 begins a purging procedure. Processor 40 directs purging printhead 70A and purging printhead cleaning device 90A to positions in close proximity to each other so that purging fluid 100 expelled from purging printhead 70A is received by purging printhead cleaning device 90A. FIG. 3 illustrates a plurality of purging printheads 70A and a plurality of purging printhead cleaning devices in close proximity.

Returning to FIG. 2, processor 40 directs purging printhead 70A to print continuously for a first time period, causing purging fluid 100 from purging reservoir 60A to enter tube 80 and emptying tube 80 of old ink 95. The first time period is selected to ensure that old ink 95 in tube 80 has been replaced by purging fluid 100. Upon completion of the purging procedure, processor 40 then begins a recharging procedure. Purging reservoir 60A is then replaced with new reservoir 60B containing new ink composition 110, and processor 40 again directs purging printhead 70A to print continuously, for a second time period, emptying tube 80 of purging fluid 100 and causing the ink composition 110 from new reservoir 60B to enter tube 80. The second time period is selected to ensure that purging fluid 100 in tube 80 has been replaced by new ink 110 and may be the same as the first time period.

Upon completion of the charging procedure, purging printhead 70A and purging printhead cleaning device 90A are replaced with new printhead 70B and new purging printhead cleaning device 90B.

Purging reservoir 60A, purging printhead 70A and purging printhead cleaning device 90A are each provided with an integral information device 120, 130, 140, respectively, which contains identifying information for each printing component. The integral information device serves to convey information identifying the printing component and other information pertaining to the component's operation. For example, the information device may be a resistor, a bar code, a memory device, or a microprocessor.

Upon installation, using information device 120 on purging reservoir 60A, processor 40 recognizes that purging reservoir 60A has been installed and checks information device 130 on purging printhead 70A and information device 140 on purging printhead cleaning device 90A to ensure that they are suited for performing a purging procedure. If the correct components are not installed, processor 40 stops the purging procedure and notifies the operator. If the printing components are part of the set of components for performing a purging procedure, processor 40 then proceeds to identify the procedure to be utilized. If the procedure is not present in the memory of processor 40, processor 40 requests that the operator load the procedure through the facility 45 for receiving and storing additional programs. If the procedure is present, processor 40 begins the purging procedure under program control. Because processor 40 is capable of identifying each printing component by its information device 120, 130, 140, processor 40 has the capability of ensuring that the correct components are installed for each step of the procedure, and of stopping the procedure when the components are incorrect.

In some inkjet printers, the printhead is not removable and remains in place, regardless of the ink composition being used. In a further embodiment, then, printhead 70 is not replaced and remains in place during the purging and recharging procedure. Replaceable reservoir 60 and printhead cleaning device 90, are replaced with purging reservoir 60A and purging printhead cleaning device 90A, respectively. Processor 40 then begins a purging procedure where processor 40 directs printhead 70 and purging printhead cleaning device 90A to positions in close proximity to each other so that purging fluid 100 expelled from printhead 70 is received by purging printhead cleaning device 90A. Processor 40 then directs printhead 70 to print continuously for a third time period, causing purging fluid 100 from purging reservoir 60A to enter tube 80 and emptying tube 80 of old ink 95. The third time period is selected to ensure that old ink 95 in tube 80 and any ink in the printhead has been replaced by purging fluid 100.

Upon completion of the purging procedure, processor 40 then begins a recharging procedure as described previously but for a fourth time period, selected to ensure that both tube 80 and printhead 70 are emptied of purging fluid 100 and filled with ink composition 110 from new reservoir 60B. Upon completion of the charging procedure, purging printhead cleaning device 90A is replaced with new purging printhead cleaning device 90B.

As can be seen from the above, incompatibility between different ink compositions may be avoided by purging the old ink from the ink delivery system. The purging procedure may be accomplished by having the operator change consumable printing components and may be done automatically, under program control.

Thus, while the invention has been particularly shown and described with respect to preferred embodiments thereof, it will be understood by those skilled in the art that changes in form and details may be made therein without departing from its scope and spirit.

What is claimed is:

1. A method of purging a tube in an ink delivery system in a printer, said tube having an inlet end and an outlet end, with said outlet end in fluid communication with a printhead, said method comprising the steps of:

a) replacing a plurality of components of said ink delivery system with a plurality of purging components;

b) recognizing that said plurality of purging components is present by reading identifying data from said plurality of purging components;

c) in response to recognizing that said plurality of purging components is present, introducing a purging fluid into said inlet end of said tube;

d) operating said printhead to cause said purging fluid to flow through said tube and be expelled by said printhead; and, e) collecting said purging fluid expelled from said printhead.

2. The method of claim 1 wherein said ink delivery system further comprises a first reservoir in fluid communication with said inlet end of said tube, and step a) further comprises providing a purging reservoir containing a purging fluid, coupled to said inlet end of said tube.

3. The method of claim 2 wherein step a) further comprises providing a printhead cleaning device and step e) employs said printhead cleaning device to collect said purging fluid.

4. The method of claim 3 further comprising after step e), the steps of:

f) introducing an ink into said inlet end of said tube;

g) operating said printhead to cause said ink to flow through said tube, and be expelled by said printhead; and, h) collecting said ink expelled from said printhead employing said printhead cleaning device.

5. The method of claim 4 wherein step f) further comprises providing a third reservoir containing ink so that it is coupled to said inlet end of said tube.

6. The method of claim 4 further comprising after step h), the steps of:

i) replacing said printhead cleaning device with a second printhead cleaning device, prior to operating said printer to output printed documents.

7. The method of claim 4 wherein said printer further comprises a microprocessor capable of directing the operation of said printer, and said purging reservoir, said printhead and said printhead cleaning device include integral information devices capable of providing identifying information to said microprocessor.

8. The method of claim 7 wherein in step b) said microprocessor verifies the identifying information provided by said integral information devices contained in said purging reservoir, said printhead and said printhead cleaning device to ensure that said purging reservoir, said printhead and said printhead cleaning device are suitable for performing a purging procedure.

9. The method of claim 1 wherein step a) further comprises providing a purging printhead in said printer so that it is connected to said outlet of said tube.

10. An apparatus for purging a tube in an ink delivery system in a printer, said printer controlled by a processor, said tube having an inlet end and an outlet end with said inlet end in fluid communication with a first reservoir, said outlet end in fluid communication with a printhead, said printhead capable of fluid communication with a first printhead cleaning device, said apparatus comprising:

a purging reservoir containing a purging fluid, installed in place of said first reservoir;

a second printhead cleaning device installed in place of said first printhead cleaning device for collecting fluids during purging; and, program means for controlling said processor in said printer upon installation of said purging reservoir, said printhead, and said second printhead cleaning device, wherein said program means causes said microprocessor to operate said printhead to cause said purging fluid to flow through said tube and be expelled by said printhead and to be collected by said second printhead cleaning device.

11. An apparatus for purging a tube in an ink delivery system as recited in claim 10, wherein said purging reservoir, said printhead and said second printhead cleaning device contain integral information devices capable of providing identifying information to said microprocessor.

12. An apparatus for purging a tube in an ink delivery system as recited in claim 11, wherein said program means, before causing said microprocessor to operate said printhead, causes said microprocessor to verify the identifying information provided by said integral information devices contained in said purging reservoir, said printhead and said second printhead cleaning device to ensure that said purging reservoir, said printhead and said second printhead cleaning device are suitable for performing a purging procedure.

13. An apparatus for purging a tube in an ink delivery system as recited in claim 10, wherein said purging fluid is an ink solvent.

14. An apparatus for purging a tube in an ink delivery system as recited in claim 10, further comprising a purging printhead installed in place of said first printhead for purging.

15. A kit for purging a tube in an ink delivery system in a printer, said printer controlled by a processor, said tube having an inlet end and an outlet end with said inlet end in fluid communication with a first reservoir, said outlet end in fluid communication with a printhead, said printhead capable of fluid communication with a first printhead cleaning device, said kit comprising:

a purging reservoir containing a fluid, installable in place of said first reservoir;

a second printhead cleaning device installable in place of said first printhead cleaning device for collecting fluid during purging; and, program means for controlling said processor in said printer upon installation of said purging reservoir, said printhead, and said second printhead cleaning device, wherein said program means causes said microprocessor to operate said printhead to cause said purging fluid to flow through said tube and be expelled by said printhead and to be collected by said second printhead cleaning device.

16. A kit as recited in claim 15, wherein said purging reservoir, said printhead, and said second printhead cleaning device contain integral information devices capable of providing identifying information to said microprocessor.

17. A kit as recited in claim 15, wherein said purging fluid is an ink solvent.

18. A kit as recited in claim 15, further comprising a purging printhead, installable in place of said first printhead for purging.

19. A computer storage media including instructions for controlling a processor that controls a printer, said printer comprising:

a tube having an inlet end and an outlet end with said inlet end in fluid communication with a first reservoir, said outlet end in fluid communication with a first printhead, said first printhead capable of fluid communication with a printhead cleaning device, a purging reservoir containing a purging fluid, installed in place of said first reservoir; and, a second printhead cleaning device installed in place of said first printhead cleaning device for collecting fluids during purging;

said computer storage media comprising:

a) means for controlling said processor to cause said first printhead and said second printhead cleaning device to be positioned in close proximity;

b) means for controlling said processor to operate said first printhead to cause said purging fluid to flow through said tube, to be expelled by said first printhead and be collected in said second printhead cleaning device, wherein said purging reservoir, said first printhead and said second printhead cleaning device contain integral information devices capable of providing identifying information to said microprocessor, said computer storage media further comprising:

c) means for controlling said processor such that before causing said first printhead and said second printhead cleaning device to be positioned in close proximity, said microprocessor verifies the identifying information provided by said integral information devices contained in said purging reservoir, said first printhead and said second printhead cleaning device to ensure that said purging reservoir, said first printhead and said second printhead cleaning device are suitable for performing a purging procedure.

20. The computer storage media of claim 19 wherein said printer further comprises a purging printhead, installable in place of said first printhead for purging.

* * * * *